United States Patent [19]

Youngblood et al.

[11] Patent Number: 4,518,037

[45] Date of Patent: May 21, 1985

[54] RETRIEVABLE WELL TOOL

[76] Inventors: Harold C. Youngblood, Rte. 1, Box 170 - Ivanhoe, Woodville, Tex. 74979; Kenneth L. Champeau, 8204 NW. 90th Ter., Oklahoma City, Okla. 73132

[21] Appl. No.: 329,181

[22] Filed: Dec. 10, 1981

[51] Int. Cl.[3] ..... E21B 33/129

[52] U.S. Cl. ..... 166/125; 166/138; 166/182; 166/192; 166/240

[58] Field of Search ..... 166/119, 123, 125, 135, 166/138, 142, 182, 192, 216, 217, 240, 382, 387

[56] References Cited

U.S. PATENT DOCUMENTS

| | | | |
|---|---|---|---|
| 2,893,492 | 7/1959 | Brown | 166/119 |
| 3,211,233 | 10/1965 | Brown | 166/216 |
| 3,412,790 | 11/1968 | Brown | 166/382 |
| 4,059,150 | 11/1977 | Manderscheid | 166/216 |
| 4,078,606 | 3/1978 | Montgomery | 166/138 |

*Primary Examiner*—Stephen J. Novosad
*Assistant Examiner*—William P. Neuder
*Attorney, Agent, or Firm*—Alan T. McCollom

[57] ABSTRACT

A retrievable well tool which can be lowered into a well casing and set on a wire line and thereafter moved for resetting or retrieval with a drill string. The tool includes a body having expandable slips mounted thereabout for anchoring with the casing. Drag blocks which are longitudinally slidable along the body slide from a first to a second position to expand the slips. A lug on the drag blocks is received into a channel on the body. Manipulation of the plug body effects locking the drag blocks into their first position. Shear bolts maintain the drag blocks in their first position when the tool is initially lowered into the casing on a wire line. A shiftable abutment adjacent the drag blocks is selectively operated to shear the bolts and shift the drag blocks to their second position to anchor the tool. Thereafter, a drill string may be lowered into the casing and connected to the tool in order to shift the drag blocks to their first position so that the tool can be retrieved or reset in the casing with the drill string.

19 Claims, 7 Drawing Figures

RETRIEVABLE WELL TOOL

BACKGROUND AND SUMMARY OF THE INVENTION

The instant invention relates to a well tool and more particularly to such a tool which is designed to be set into a well casing on a wire line.

Various kinds of well tools are constructed to be lowered into a casing and anchored to the casing at a selected level. Such anchoring is typically achieved by expandable slips which grip the casing to prevent movement of the tool when expanded. In most such tools, a slidable portion on the body of the tool slides from a first position to a second position in order to effect slip expansion. On tools of the retrievable type, the slidable portion includes drag blocks which frictionally engage the interior casing surface. When the tool is lowered, a locking mechanism maintains the drag blocks in a position which prevents slip expansion. The tool is lowered on a drill string which is then manipulated to effect movement of the tool body relative to the drag blocks in order to release the locking mechanism to permit slip expansion.

Some tools are intended to be anchored to the casing only once and thereafter retrieved. Generally, such tools are suspended from a conventional wire line setting assembly which in turn is suspended from a wire line and lowered into a casing. The wire line setting assembly includes a power source, typically a hydraulic cylinder, which is attached to the slidable portion of the tool. When the tool is positioned at a desired depth, a signal from the surface actuates the piston which moves the slidable portion of the tool into the position in which the slips expand thus anchoring the tool. The same piston movement which sets the tool shears a bolt connecting the setting assembly to the tool and, after setting, the setting assembly and wire line are raised to the surface. A conventional drill string is used to retrieve the tool to the surface. Due to the construction of such tools, the tool must be retrieved to the surface prior to resetting the tool in the casing. Such retrieval is necessary to repair the setting mechanism which may require, e.g., new shear bolts.

It can be readily seen that setting such tools on a wire line provides a great saving in time and labor expense over setting of tools on drill strings. When a tool is set on a drill string, the pipe must be added to the string one section at a time as the tool is lowered into the casing. This is time consuming as well as labor extensive in that a drilling rig operator must start and stop the drill power source to permit several men to add tubing to the drill string one section at a time. When a wire line is used to set a tool, the tool is suspended from the line and the line is typically unwound from a reel, thus permitting quick lowering of the tool to a selected depth. A main drawback of prior tools which are set on wire lines is that they must be retrieved to the surface prior to resetting the tool at a different depth.

It is an object of the present invention to provide a tool and a method for using the same which permits an initial setting of the tool in the well casing on a wire line and thereafter permits unsetting and retrieval or resetting of the tool in the casing with the use of a drill string.

It is another object of the invention to provide such a tool which can be used with a conventional wire line setting assembly and with a conventional overshot suspended from a drill string.

It is a more specific object of the invention to provide such a tool which, although retrievable and resettable, may be firmly locked in a casing-engaging condition when set.

The instant invention includes a tool having a body with anchor slips mounted thereabout. The slips are attached to drag blocks which move from a first position to a second position in order to expand the slips for engagement to the casing. A slidable abutment is provided adjacent the drag blocks for moving them to their second position. A lug on the drag blocks is received within a channel formed in the tool body. Initially, shear bolts connect the drag blocks to the tool body to maintain the blocks in their first position. The tool is lowered into the casing on a conventional wire line setting assembly which includes means for selectively moving the slidable abutment so as to shear the shear bolts while moving the drag blocks from their first to their second position. A ratchet locking means disposed between the drag blocks and the tool body is provided to maintain the slips in a casing-engaging condition.

When it is desired to retrieve or to reset the tool at a different depth in the casing, a drill string is lowered having a conventional overshot suspended therefrom. The drill string is connected to the tool with the overshot. Manipulation of the drill string effects rotational and longitudinal movement of the tool body relative to the drag blocks. Such movement unlocks the ratchet mechanism and permits movement of the drag blocks to their first position. Thereafter, the tool may be retrieved or reset in the casing, such resetting being effected with drill string manipulation to achieve movement of the drag blocks relative to the tool body.

These and other objects and advantages of the invention will become more fully apparent when the following detailed description is read in view of the accompanying drawings.

DETAILED DESCRIPTION OF A PREFERRED EMBODIMENT OF THE INVENTION

Figure 1A:
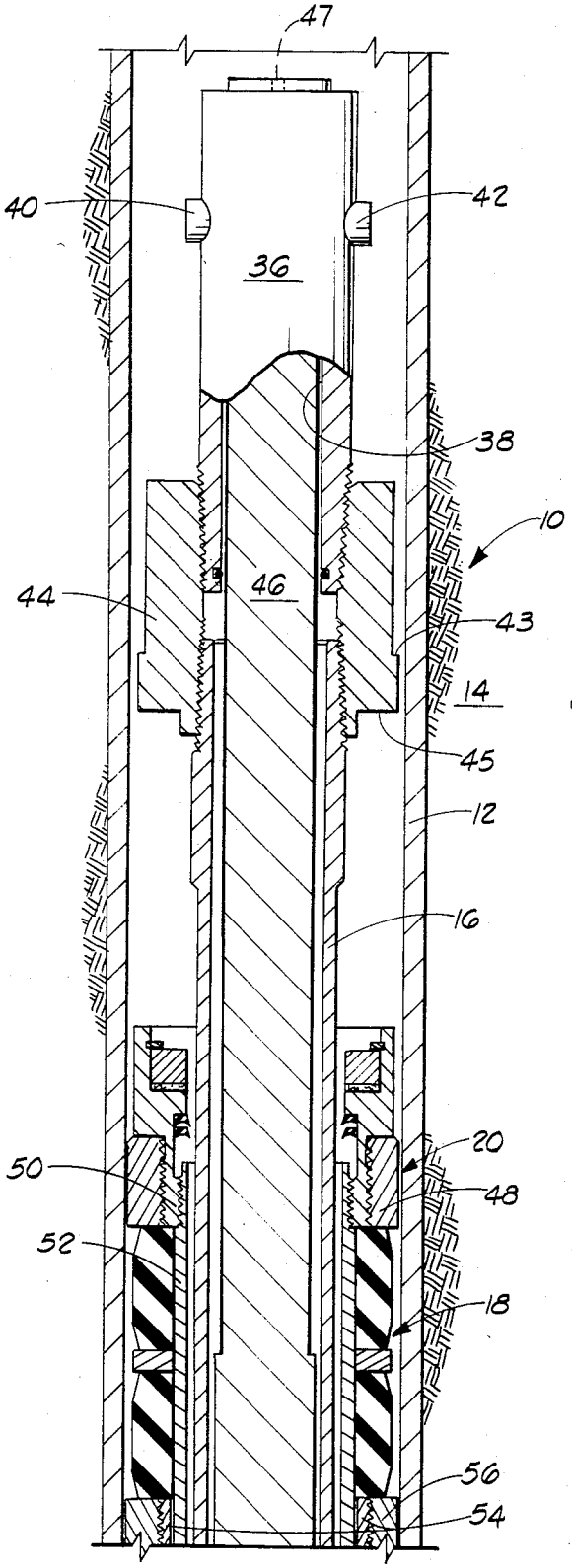
FIGS. 1A and 1B comprise a partial cross-sectional view of the instant embodiment of the invention suspended in a casing in its initial running-in condition, FIG. 1B being a successive downward continuation of FIG. 1A.
Figure 1B:
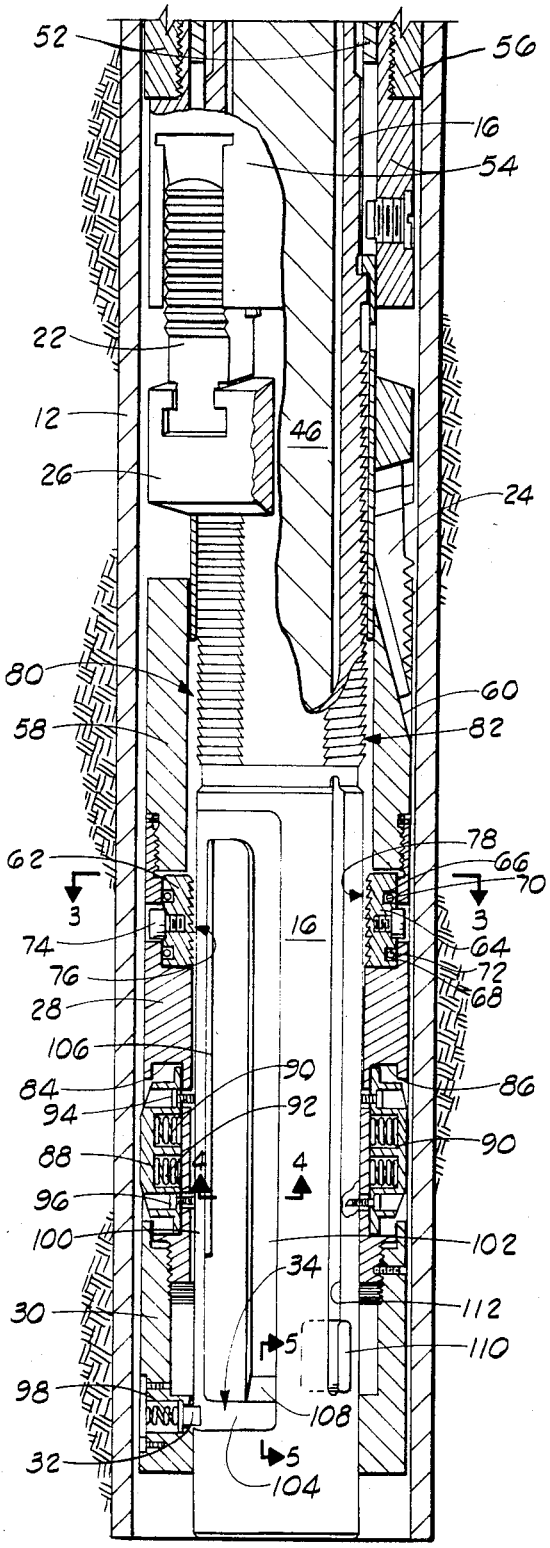

Turning now to the drawings and particularly to FIGS. 1A and 1B, indicated generally at 10 is a preferred embodiment of the tool of the instant invention. The tool is suspended in a well casing 12 which has been cemented into a bore hole in formation 14.

In the instant embodiment of the invention, tool 10 is a retrievable bridge plug. Such plugs are used to seal a well casing, like casing 12, at a selected depth. Tool 10 is designed to be suspended in the casing from a wire line pressure setting assembly (not shown) or from a conventional overshot (also not shown). The wire line setting assembly and tool are lowered into the casing on a wire line while the overshot is connected to the lower end of a tubing string which extends downwardly into the casing. In the drawings, neither the wire line setting assembly nor the overshot is shown; however, it is to be appreciated that when the plug is not set in the casing, it is suspended from either the overshot or the wire line setting assembly. The drawings illustrate tool 10 without any means of support so that all of the structure of tool 10 may be clearly viewed. As will become apparent in the following description, certain structure on tool 10 cooperates with a conventional overshot and with a wire line setting assembly to enable vertical movement of the tool in the casing.

Speaking now only generally of the structure and operation of tool 10, a tool body 16 is generally cylindrically shaped and extends along the length of tool 10. Elastomeric packers indicated generally at 18 extend about tool body 16 beneath a packer compressor, indicated generally at 20. The packer compressor extends about the body immediately above the packers. Upwardly facing slips, one of which is slip 22, and downwardly facing slips, one of which is slip 24, are mounted on a cylindrical slip ring 26 that is slidably mounted on body 16.

A drag block housing 28 is generally cylindrically shaped and extends about the circumference of body 16. A control lug housing 30 is threadably engaged to the lower end of drag block housing 28. A control lug 32 extends from housing 30 into a channel formed in body 16, indicated generally at 34.

In operation, tool 10 is lowered to a selected depth in casing 12 at which it is desired to seal the casing. As will later become more fully apparent, when drag block housing 28 is shifted upwardly, the slips, including slips 22, 24, expand radially outwardly and engage the interior of casing 12, thus preventing upward or downward movement of the tool. Packer compressor 20 is forced downwardly against packers 18 thus deforming the packers into a casing-sealing condition. The following detailed description explains the manner in which lug 32 and channel 34, as well as other structure, cooperate to permit initially setting the tool on a wire line and thereafter resetting it with a tubing string and a conventional overshot.

Examining now in more detail the structure of tool 10, attention is directed to FIGS. 1A and 1B. A retrieving head 36 is cylindrically shaped and includes a bore 38 along its axis. A pair of lugs 40, 42 extend at right angles from head 36. The lower end of head 36 is threadably engaged to a compression sub 44. Compression sub 44 extends about the circumference of both retrieving head 36 and tool body 16 and includes interior threads on each end with which the head and the body are engaged. The sub includes an upwardly facing shoulder 43 and a downwardly facing shoulder 45, each of which are formed around the circumference of the sub. A compression rod 46 is cylindrically shaped and extends along the length of the tool from retrieving head 36 to near the bottom of body 16. The top of rod 46 has a threaded bore 47 in alignment with the vertical axis of the rod.

Included within packer compressor 20 is a gauge ring 48, a seal retainer 50 and a support sleeve 52. Sleeve 52 is cylindrically shaped and is mounted over body 16. Ring 48, retainer 50 and the top of sleeve 52 are threadably engaged as shown. The bottom of ring 58 and of retainer 52 present a flat surface against the top side of packers 18. Sleeve 52, and thus the structure included within packer compressor 20 is slidable along body 16. When the packers are restrained from vertical movement and when packer compressor 20 is forced downwardly, packers 18 are deformed and expand outwardly to seal the casing.

An upper cone 54 extends about sleeve 52 beneath packers 18. Cone 54 is generally cylindrically shaped and includes incline surfaces (not visible) formed in the outer surface of the cone which receive and cooperate with each of the slips, like slip 22. A gauge ring 56, like gauge ring 48, is threadably engaged about the outer upper surface of cone 54.

A lower cone 58 extends about body 16 and includes inclines, like incline 60, which cooperate with the downwardly facing slips, like slip 24. Each of the cones 54, 58 include four inclines, like incline 60, which are positioned at 90° intervals about the circumference of the cone. Four downwardly facing slips, like slip 24, are suspended at 90° intervals about the circumference of slip ring 26 and cooperate with each of the inclines like slip 24 cooperates with incline 60. Four upwardly facing slips, like slip 22, are mounted on slip ring 26 about its circumference and cooperate with associated inclines in cone 54.

Drag block housing 28 is threadably engaged to the lower end of cone 58. Four collar segments, like segments 62, 64, are constrained within a channel formed between lower cone 58 and drag block housing 28. Each of the segments has an upper and lower groove, like grooves 66, 68, in segment 64, in which resides springs 70, 72. A screw, one for each segment, like screw 74 in segment 62, extends into each segment through an associated hole in the drag block housing.

Figure 3:
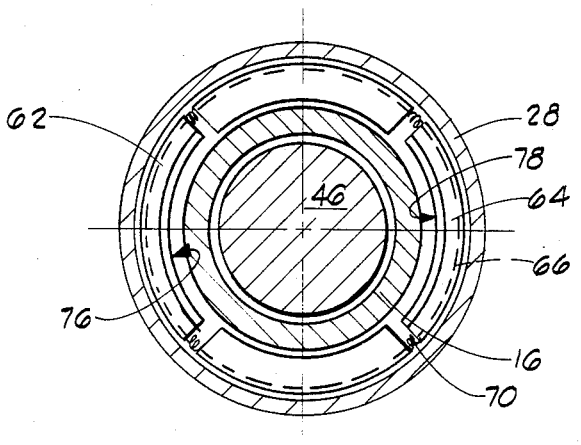
FIG. 3 is a cross-sectional view taken along line 3—3 in FIG. 1B.

The radially interior surface of segments 62, 64 have formed therein downwardly facing cams, indicated generally at 76, 78, respectively. Two portions of the exterior of body 16 have upwardly facing cams formed therein, such cams being indicated generally at 80, 82. As will later be seen, in the operation of tool 10, when drag block housing 28 is shifted upwardly, the downwardly facing cams on segments 62, 64, engage with upwardly facing cams 80, 82, respectively, to maintain packers 18 in a compressed condition. FIG. 3 illustrates the radial position of each of the collar segments about the surface of body 16.

Included at 90° intervals about the circumference of drag block housing 28 are recesses, like recesses 84, 86. Constrained within each recess is a drag block, like drag block 88 in recess 84. Each drag block includes springs, like springs 90, 92, for drag block 88. The springs bias the blocks outwardly toward casing 12. Each of the radially outward surfaces of the blocks has a relatively high coefficient of friction. Shear bolts 94, 96 bolt drag block 88 to body 16. Similar shear bolts on each of the other drag blocks bolt the block to the body. Such bolting prevents vertical movement of the drag blocks (and of drag block housing 28 and lower cone 58) relative to body 16.

Figure 4:
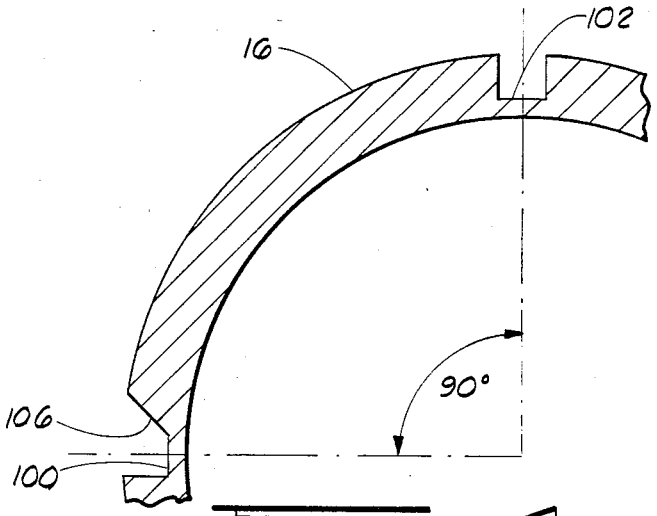
FIG. 4 is a portion of a cross-sectional view taken along line 4—4 in FIG. 1B.
Figure 5:
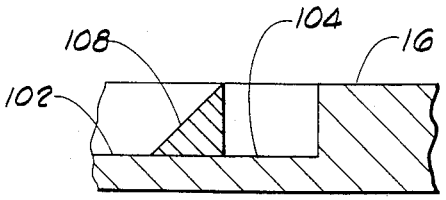
FIG. 5 is a portion of a cross-sectional view taken along line 5—5 in FIG. 1B.

Control lug housing 30 is threadably mounted on the lower end of drag block housing 28. A spring 98 biases lug 32 radially inwardly from housing 30, the lug being received within channel 34 on body 16. Channel 34 includes a first passage 100, a second passage 102 and a third passage 104. A ramp 106 is formed along a portion of the first passage. A second ramp 108 is formed at the lower end of the second passage. The relationship of ramps 106, 108 to each of the passages is best seen in FIGS. 4 and 5.

A cross link 110 extends radially outwardly from rod 46 through a slot 112 formed in body 16. Cross link 110 extends from slot 112 just beneath drag block housing 28.

Operation

To initially set tool 10 at a selected depth in casing 12, the tool is first suspended on a wire line from a conventional wire line setting assembly. The assembly is of the type which includes a hydraulic cylinder which is actuated responsive to an electrical signal. The assembly is mounted on post 46 with a shear bolt in bore 47 at the top of the post. The assembly includes a cylindrical outer portion which fits over head 36 and abuts against shoulder 43 on compression sub 44. When the tool is so mounted on the wire line setting assembly at the surface, the wire line is then paid out until the tool is at the depth at which the casing is to be sealed. During lowering of the tool, it is in the configuration shown in FIGS. 1A and 1B, that is, drag block housing 28 is at its lowermost position and lug 32 is located at the bottom of passage 100. The drag block assembly (and thus lower cone 58) is restrained from both vertical and rotational movement relative to body 16 due to the shear bolts, like shear bolts 94, 96, which mount each of the drag blocks on body 16. Since lower cone 58 is at its lowermost position, each of the downwardly and upwardly facing slips are at their radially innermost positions and do not contact the casing while the tool is being lowered. Packers 18 are in a decompressed condition as shown in FIG. 1A. Packer compressor 20 rides on top of the packers; however, no downward force is placed on the packer compressor thus leaving the packers in a decompressed condition.

When the selected depth at which the tool is to be set is reached, lowering is stopped and an electric signal from the surface actuates the wire line setting assembly. The electric signal causes the piston in the assembly to throw which pulls upwardly on rod 46 while the previously mentioned cylindrical portion of the assembly presses downwardly on shoulder 43 of compression sub 44.

Figure 2A:
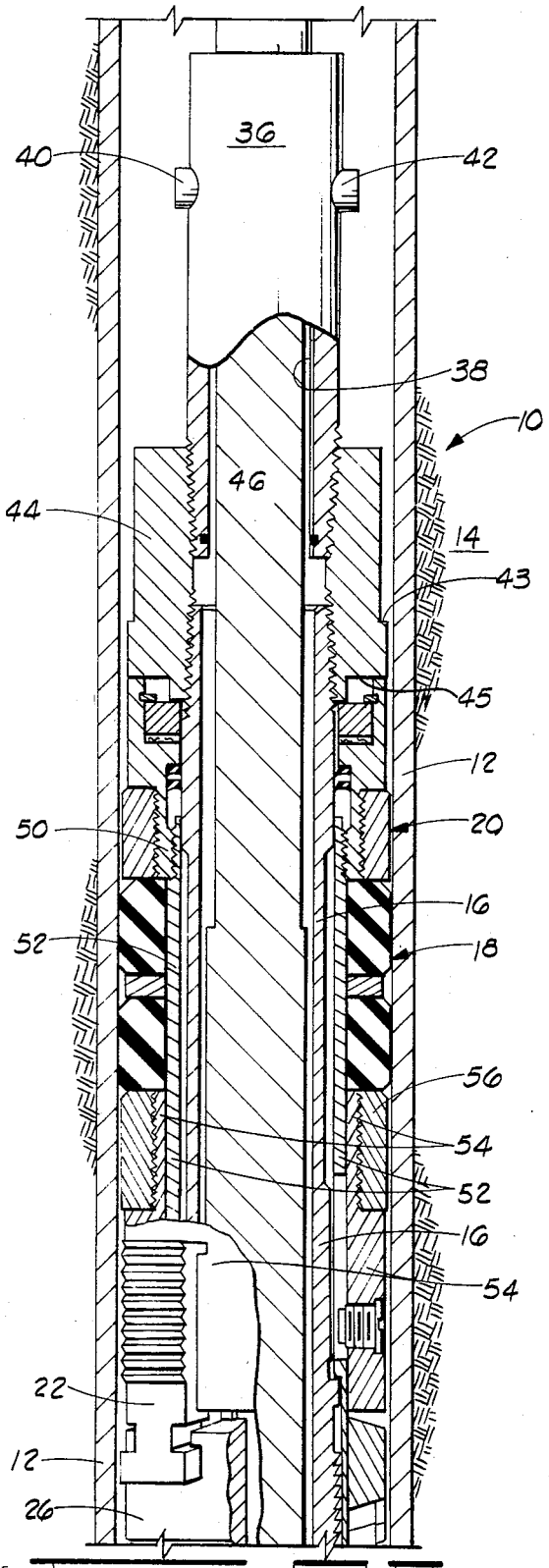
FIGS 2A and 2B are partial cross-sectional views of the tool of FIGS. 1A and 1B in a set condition in the casing.
Figure 2B:
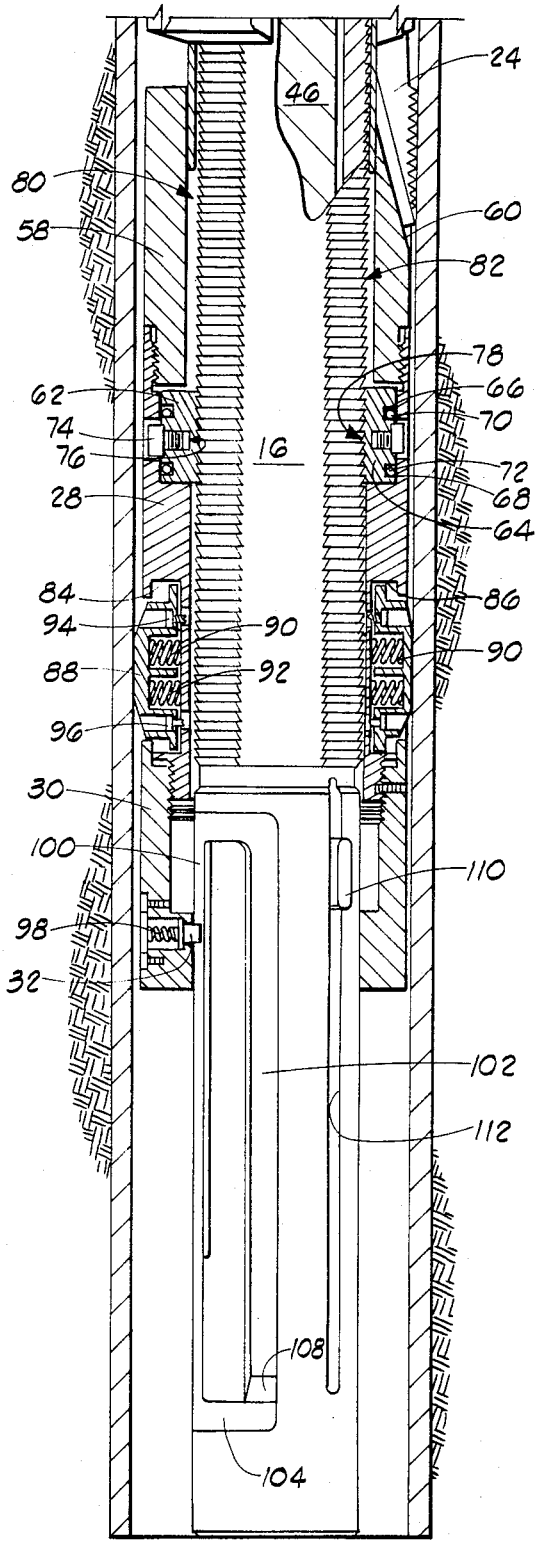

The action exerted by the wire line setting assembly changes the relative position of the structure of the tool from that shown in FIGS. 1A and 1B to that of FIGS. 2A and 2B as follows: the downward action on compression sub 44 moves body 16 downwardly while cross link 110, mounted on the lower end of rod 46 moves upwardly against the lower end of drag block housing 28. This action causes each of the shear bolts, like bolts 94, 96, which mount the drag blocks on body 16 to shear and permits upward movement of the drag block housing.

The upward movement of the housing also moves lower cone 58 upwardly against the downwardly facing slips, like slip 24. In FIG. 1B, as the lower cone moves upwardly, incline 60 acts on slip 24 to cause radially outward movement of the slip, the other inclines cause radially outward movement of each of the other slips. Shoulder 45 on compression sub 44 abuts against the upper surface of packer compressor 20 thus compressing packers 18 downwardly and causing downward movement of upper cone 54. Such downward movement of the upper cone continues until the upwardly facing slips, like slip 22, are forced radially outwardly to engage the casing. When all of the slips are engaged with the casing, the downward action on compression sub 44 deforms packers 18 into a casing-sealing condition as shown in FIG. 2A.

When drag block housing 28 moves upwardly, each of the four collar segments, like segments 62, 64, move upwardly as well. Since the segments are spring biased inwardly by springs 66, 68, downwardly facing cam portions 76, 78 engage upwardly facing cams 80, 82 on body 16 as shown in FIG. 2B. Once so engaged, body 16 can move only in a downward direction relative to drag block assembly 28. This locking action serves to maintain compression sub 44 against packer compressor 20 thus maintaining packers 18 in a deformed casing-sealing condition as well as maintaining both lower and upper cones in a position which forces all of the slips radially outwardly to engage the casing.

As will be recalled, the wire line setting assembly is mounted on tool 10 with a shear bolt in bore 47 on the top of rod 46. At the end of the throw of the piston when the structure of the tool is moved into the configuration shown in FIGS. 2A and 2B, the shear bolt shears to permit raising the wire line setting assembly to the surface. Thus, the tool is left set in the casing with all of the slips engaging the casing and with the packers deformed so as to seal the casing.

When a certain treatment, e.g., acidizing, cementing, stimulation, etc., is performed in the casing above the plug, it may be desirable to remove the plug and to reset it at a different level to permit additional treating of another interval in the well. In order to disengage tool 10 from the well, a conventional overshot is mounted on the end of a drill string which is lowered into casing 12 to the tool. The overshot is designed to engage the tool on lugs 40, 42 on retrieving head 36. Once the overshot is lowered onto head 36 and rotated, lugs 40, 42 engage the overshot in a manner which permits both rotational and vertical movement of head 36 (and thus of body 16).

After the overshot is engaged with retrieving head 36, the drill string is rotated to the right, thus rotating body 16. Body 16 is rotated 90° to the right which disengages the downwardly facing cams on collar segments 62, 64 from the upwardly facing cams 80, 82 on body 16. As can be seen in FIG. 3, when body 16 is rotated 90° to the right, the cam portions on body 16 are no longer engaged with the cams on the radially inner surfaces of segments 62, 64 but are facing the radially inner surfaces of the other two segments which have no cams formed thereon. Such right-hand rotation also serves to change the position of lug 32 with respect to body 16. Instead of being received within channel 100, the lug is received within channel 102. Ramp 106 permits the lug to "travel" up the ramp and across body 16 to be received within channel 102.

After rotation of body 16 to unlock the cams and to change lug 32 from the first to the second passage, the drill string is raised, thus raising body 16. As will be recalled, when the tool was initially set, all of the shear bolts which maintained the drag blocks in a radially inward position were sheared thus permitting the drag blocks to abut against the interior of casing 12. When the tool is raised, the drag blocks frictionally engage the casing and maintain drag block housing 28 as well as lower cone 58 stationary relative to body 16. This permits raising of body 16 until lug 32 is pressed radially outwardly by ramp 108 at the bottom of passage 102 and thereafter drops into passage 104. As can be seen in FIGS. 1B and 5, when lug 32 is received within passage 104, the drag block assembly, and thus lower cone 58, are maintained in their lowermost positions relative to body 16. When so maintained, the upper and lower cones are in a position which prevent engagement of the slips with the casing. Thus, the tool may now be moved on the end of the drill string to a new location for resetting. When being so moved, lug 32 is received within channel 104 just beneath ramp 108.

When the new location at which the plug is to be set is reached, the drill string is rotated to the left 90° thus moving tool body 16 relative to lug 32 into the position shown in FIG. 1B. Since the shear bolts on the drag blocks have been previously sheared, downward movement of the drill string moves body 16 downwardly while the drag blocks maintain drag block housing 28 and lower cone 58 stationary relative to body 16. Thus, the downwardly facing slips are forced outwardly to engage the casing. Additional downward movement of the drill string forces compression sub 44 into the top of packer compressor 20 thus compressing the packers and forcing the upwardly facing slips into the casing. Collar segments 62, 64 are once again in a position to engage the cams 76, 78 on the collar segments with cams 80, 82 on tool body 16 thus locking body 16 to maintain the packers in a compressed condition as well as maintaining both lower and upper cones in a position which forces the slips into engagement with the casing. Thereafter, rotational and longitudinal movement of the drill string disengages the overshot from the plug and the drill string may be raised leaving the tool set in its new position in the casing. The drill string and overshot may then be lowered onto the tool to either retrieve it to the surface or to reset it at a new location in the casing.

While a preferred embodiment of the tool has been shown, it is to be appreciated that those skilled in the art may incorporate the invention into different tools using modifications which do not depart from the spirit of the instant invention.

We claim:

1. Apparatus for use in a well casing comprising,
a body;
slip means mounted on said body having a retracted and an expanded position;
drag means slidably mounted on said body adjacent said slip means for longitudinal and for radially inner and outer movement, said drag means being movable from a first longitudinal position to a second longitudinal position to shift said slip means into an expanded position for engagement with the well casing;
first means for maintaining said drag means in its first longitudinal position and in its radially inner position including shear bolt means; and
second means for maintaining said drag means in its first longitudinal position including lug and channel means.

2. The apparatus of claim 1 wherein said shear bolt means comprises shear bolts for mounting said drag means on said body and wherein said apparatus further includes shift means mounted on said body adjacent said drag means, said shift means being selectively movable against said drag means to shear said bolts while moving said drag means to its second position.

3. The apparatus of claim 2 wherein said lug and channel means includes a lug and a channel, said channel being formed in said body and said lug being mounted on said drag means and receivable within said channel.

4. The apparatus of claim 3 wherein said channel includes a horizontal passage for receiving said lug to maintain said drag means in its first position.

5. The apparatus of claim 4 wherein said channel includes a vertical passage joined to said horizontal passage to permit relative horizontal and vertical movement of said lug and channel.

6. A retrievable bridge plug for use with a wireline setting assembly and with a drill string, said bridge plug being of the type having an elastomeric packer mounted on a body, said packer being deformable between a packer compressor and casing anchors when said casing anchors are anchored to a well casing, said plug comprising,
casing drag means operatively connected to the casing anchors, said drag means having longitudinal first and second positions and radially inner and outer positions, said drag means being operable to prevent anchor casing engagement in a first longitudinal position and to cause anchor casing engagement in a second longitudinal position, said drag means being further operable to permit anchor casing engagement via drill string manipulation when said drag means are in their radially outer position;
shear bolt means mounted on said casing drag means, said shear bolt means maintaining said drag means in its first longitudinal position and in its radially inner position;
shift means operatively connected to said drag means, said shift means being selectively operable to shear said bolt means and to shift said drag means from its first position to its second position; and
means interconnecting said drag means to the plug body, said interconnecting means permitting movement, after shearing of said bolt means, of said drag means to its first position responsive to drill string manipulation.

7. The apparatus of claim 6 wherein said interconnecting means further includes means for permitting movement of said drag means from its first position to its second position responsive to drill string manipulation.

8. The apparatus of claim 6 which further includes packer compressor locking means interconnected between said drag means and the packer compressor, said locking means locking said packer compressor in a packer-deforming condition when said drag means is in its second position, and releasing said locking means responsive to rotation of the body, and wherein said shear bolt means includes shear bolts, said shear bolts shearably securing said drag means to the packer compressor.

9. The apparatus of claim 8 wherein said interconnecting means includes first and second longitudinal passages formed on the body and a lug mounted on said drag means and receivable within said passages, said packer compressor locking means being in a locked condition when said lug is received in said first passage and being in a released condition when said lug is received within said second passage.

10. The apparatus of claim 9 wherein said first passage includes means to permit packer compressor rotation to permit said lug to be received within said second passage.

11. The apparatus of claim 10 which further includes a third passage formed on the packer compressor between said first and second passages at their lower ends, said drag means being maintained in its first position when said lug is received within said third passage.

12. The apparatus of claim 11 wherein said second passage includes means to permit longitudinal movement of the packer compressor to permit said lug to be received within said third passage.

13. A retrievable bridge plug for use in a well casing comprising, a plug body;

an elastomeric packer mounted about said body;

slip means mounted on said body, said slip means being movable from a retracted position to an expanded position for engagement with said casing;

packer compressor means mounted on said body for pressing said packer against said slips, when said slips are engaged with the casing;

drag means mounted on said body and being movable from a first to a second longitudinal position to expand said slip means;

ratchet means mounted between said drag means and said body for maintaining said packer compressor means in a packer-deforming condition and said slips in a casing-engagement condition, said ratchet means being in an engaged condition in a first rotational position of said drag means relative to said body and being in a disengaged condition in a second rotational position of said drag means relative to said body;

a channel formed in said body adjacent said drag means;

a lug extending from said drag means and being receivable within said channel;

a first vertical passage included within said channel for maintaining said drag means and said body in their first rotational position when said lug is received therein;

a second vertical passage included within said channel for maintaining said drag means and said body in their second rotational position when said lug is received therein;

a horizontal passage included within said channel to maintain said drag means in its first longitudinal position when said lug is received therein; and friction means mounted on said drag means for frictionally engaging the casing to permit relative longitudinal and rotational movement of said plug body with respect to said drag means.

14. The apparatus of claim 13 wherein said first vertical passage includes first ramp means to permit movement of said lug across said plug body from said first vertical passage to said second vertical passage.

15. The apparatus of claim 13 wherein said channel further includes second ramp means formed between said second vertical passage and said horizontal passage said second ramp means permitting lug movement from said second vertical passage to said horizontal passage and prohibiting lug movement from said horizontal passage to said second vertical passage.

16. The apparatus of claim 13 which further includes shear bolt means for maintaining said drag means in its first longitudinal position.

17. The apparatus of claim 16 wherein said shear bolt means comprises shear bolts for mounting said drag means on said body and wherein said plug body further includes shift means mounted on said body adjacent said drag means, said shift means being selectively movable against said drag means to shear said bolts while moving said drag means to its second longitudinal position.

18. Apparatus for use in a well casing comprising, a body;

slip means mounted on said body having a retracted and an expanded position;

drag means slidably mounted on said body adjacent said slip means, said drag means being movable from a first position to a second position to shift said slip means into an expanded position for engagement with the well casing;

first means for maintaining said drag means in its first position including shear bolt means; and second means for maintaining said drag means in its first position including lug and channel means, said lug and channel means including a lug and a channel, said channel being formed in said body and said lug being mounted on said drag means and receivable within said channel.

19. A retrievable bridge plug for use with a wire-line setting assembly and with a drill string, said bridge plug being of the type having an elastomeric packer mounted on a body, said packer being deformable between a packer compressor and casing anchors when said casing anchors are anchored to a well casing, said plug comprising, casing drag means operatively connected to the casing anchors, said means being operable to prevent anchor casing engagement in a first position and to cause anchor casing engagement in a second position;

packer compressor locking means interconnected between said drag means and the packer compressor, said locking means locking said packer compressor in a packer-deforming condition when said drag means in its second position, and releasing said locking means responsive to rotation of the body;

shear bolt means mounted on said casing drag means, said shear bolt means maintaining said drag means in its first position, said shear bolt means including shear bolts for shearably securing said drag means to the packer compressor;

shift means operatively connected to said drag means, said shift means being selectively operable to shear said bolt means and to shift said drag means from its first position to its second position; and means interconnecting said drag means to the plug body, said interconnecting means permitting movement, after shearing of said bolt means, of said drag means to its first position responsive to drill string manipulation.

* * * * *